United States Patent [19]

Murakami et al.

[11] Patent Number: 4,470,694

[45] Date of Patent: Sep. 11, 1984

[54] MAGNETIC BRUSH CLEANING DEVICE FOR IMAGE FORMING APPARATUS

[75] Inventors: Sokichi Murakami, Shibuyaku; Masayoshi Furuichi, Ohtaku, both of Japan

[73] Assignees: Casio Computer Co., Ltd.; I.D. Co., Ltd., both of Tokyo, Japan

[21] Appl. No.: 450,569

[22] Filed: Dec. 17, 1982

[51] Int. Cl.[3] ..... G03G 21/00

[52] U.S. Cl. ..... 355/15; 15/256.51; 15/1.5 R

[58] Field of Search ..... 355/15, 3 R; 15/1.5, 15/256.51, 256.52; 118/652

[56] References Cited

U.S. PATENT DOCUMENTS

| | | | |
|---|---|---|---|
| 3,950,089 | 4/1976 | Fraser et al. | 355/15 X |
| 4,402,103 | 9/1983 | Yanagawa et al. | 355/15 X |
| 4,433,904 | 2/1984 | Ikemoto et al. | 355/15 X |

FOREIGN PATENT DOCUMENTS

| | | | |
|---|---|---|---|
| 46684 | 3/1982 | European Pat. Off. | 355/15 |

*Primary Examiner*—R. L. Moses

*Attorney, Agent, or Firm*—Schwartz, Jeffery, Schwaab, Mack, Blumenthal & Koch

[57] ABSTRACT

A cleaning device for an image forming apparatus includes a magnetic brush for causing a magnetic carrier and a toner to slindingly rub a surface of a photoconductor and removing the residual toner adhering on the photoconductor surface. The cleaning device further comprises a toner recovery assembly with a bias voltage applied thereto and for electrostatically attracting the surplus toner in the magnetic brush, a detector for detecting a toner density of the magnetic brush in terms of a magnetic permeability or a resistance of the magnetic brush and a bias voltage control means for controlling the bias voltage to be applied to the toner recovering system in accordance with a detected output of the toner density detector.

11 Claims, 3 Drawing Figures

MAGNETIC BRUSH CLEANING DEVICE FOR IMAGE FORMING APPARATUS

BACKGROUND OF THE INVENTION

The present invention relates to a magnetic brush cleaning device for an image forming apparatus. More particularly, it relates to a magnetic brush cleaning device which controls the density of toner in a magnetic brush material consisting of the toner and a magnetic carrier, by detecting a magnetic permeability or a resistance value that changes in accordance with increase or decrease in the quantity of the toner.

In recent years, image forming apparatuses such as electrophotographic copiers have come into wide use wherein static charges are imparted to the surface of a photoconductor by the corona discharge, the photoconductor surface is exposed to a desired image so as to form the corresponding electrostatic latent image thereon, and toner containing iron powder or the like is attracted to the electrostatic latent image portion and is thereafter transferred onto copying paper. In the image forming apparatus of this type, when the toner electrostatically attracted on the photoconductor surface is transferred to the copying paper, part of the toner remains on the photoconductor surface, so that a good copy is sometimes unattainable. In order to prevent this drawback, various devices for cleaning the photoconductor surface have been proposed.

As the cleaning devices for the photoconductor surface, there have heretofore been, for example, a device using a fur brush, a device using a fibrous web member, a device using a cleaning blade, and a device using a magnetic brush.

The cleaning device using the fur brush has been extensively employed in conventional electrophotographic copiers etc. With such cleaning device, the cleaning effect is good at the initial stage. However, the toner fuses and adheres to the brush with increase in the number of copies taken, and the cleaning property degrades gradually, so that the effective lifetime of the brush is short. Moreover, the device is so constructed as to slidingly rub the surface of the photoconductor intensely, thereby to mechanically remove the remaining toner on the photoconductor surface. This leads to such disadvantages that the photoconductor surface is damaged or is frictionally deteriorated and that the lifetime of the photoconductor is drastically shortened.

Furthermore, the toner swept away by the brush must be, for example, absorbed forcibly by a blower and recovered into a filter box. Therefore, the cleaning device becomes large in size. In turn, the copying machine itself inevitably becomes large in size.

With the cleaning device using the fibrous web member, the residual toner is removed from the photoconductor surface by the use of the web, and hence, it is required to clean the photoconductor surface with a new face at all times. In high-speed copying, accordingly, there is the tendency that the cleaning effect lowers conspicuously. To the end of solving this drawback, large quantities of new webs need to be supplied continuously. Another problem is that the photoconductor surface is damaged due to the sliding contact with the web. Therefore, this device has much room for improvement yet.

The cleaning device using the cleaning blade involves as serious disadvantages, such problems that the blade wears away much and that the photoconductor surface damages severely, particularly when the carrier has mixed in the toner on the photoconductor surface. Besides, these problems are conspicuous in high-speed copiers.

The device using the magnet brush removes the residual toner on the photoconductor surface, principally electrostatically. It is therefore meritorious in that the photoconductor surface is damaged little. On the other hand, however, it has the demerit that when the quantity of the toner in the magnetic brush portion has increased, the cleaning effect lowers suddenly. To the end of suppressing this demerit, the toner needs to be separated and removed from a magnetic brush material whose principal ingredient is the magnetic carrier. By way of example, a toner collecting member is disposed in opposing contact with, or in proximity to, the magnetic brush portion, and the toner in the magnetic brush material is shifted to the toner collecting member, thereby to separate and remove the toner from the magnetic brush material. As an expedient for such toner collection, U.S. Pat. No. 3,580,673 discloses a method in which a voltage opposite in polarity to the toner is applied to the toner collecting member. As other methods, there are considered, for example, a method in which the toner collecting member is formed of a conductive metal piece having an insulating surface and is charged by its friction with the magnetic brush material, and a method in which the toner collecting member is formed of a conductive metal and is caused to generate triboelectricity or an image force owing to its contact with the toner.

However, when the toner is collected by any of the aforementioned methods, the toner in excess of the quantity of cleaning of the residual toner from the photoconductor surface is sometimes collected from within the magnetic brush material.

In this case, the quantity of the toner in the magnetic brush portion decreases extremely, and the carrier coexisting in the magnetic brush material can contrariwise adhere to the photoconductor surface, to spoil the cleaning effect. In other words, the toner density of the magnetic brush portion needs to be controlled and maintained in a predetermined range in order to attain the optimum cleaning effect. Nevertheless, this has hitherto been neglected.

SUMMARY OF THE INVENTION

In view of the disadvantages of the prior arts, the present invention has for its object to provide a magnetic brush cleaning device in an image forming apparatus, which holds the toner density of a magnetic brush portion at a good value at all times, which can remove the remaining toner from the surface of a photoconductor favorably without any damage of the photoconductor surface, and which has a high cleaning efficiency.

In one aspect of performance of the present invention, there is provided a cleaning device in an image forming apparatus having magnetic brush means for causing a magnetic brush material, consisting of a magnetic carrier and toner, slidingly rub a surface of a photoconductor and removing the residual toner adhering on the photoconductor surface, and toner recovery means with a bias voltage applied thereto and for electrostatically attracting and recovering the surplus toner in the magnetic brush material on the basis of the applied voltage; characterized by comprising toner density detection means for detecting a toner density of the magnetic brush material, and bias voltage control means for controlling a voltage value of the bias voltage to be applied to said toner recovery means, in accordance with a detected output of said toner density detection means.

PREFERRED EMBODIMENTS OF THE INVENTION

Now, embodiments of the present invention will be described with reference to the drawings.

Figure 1:
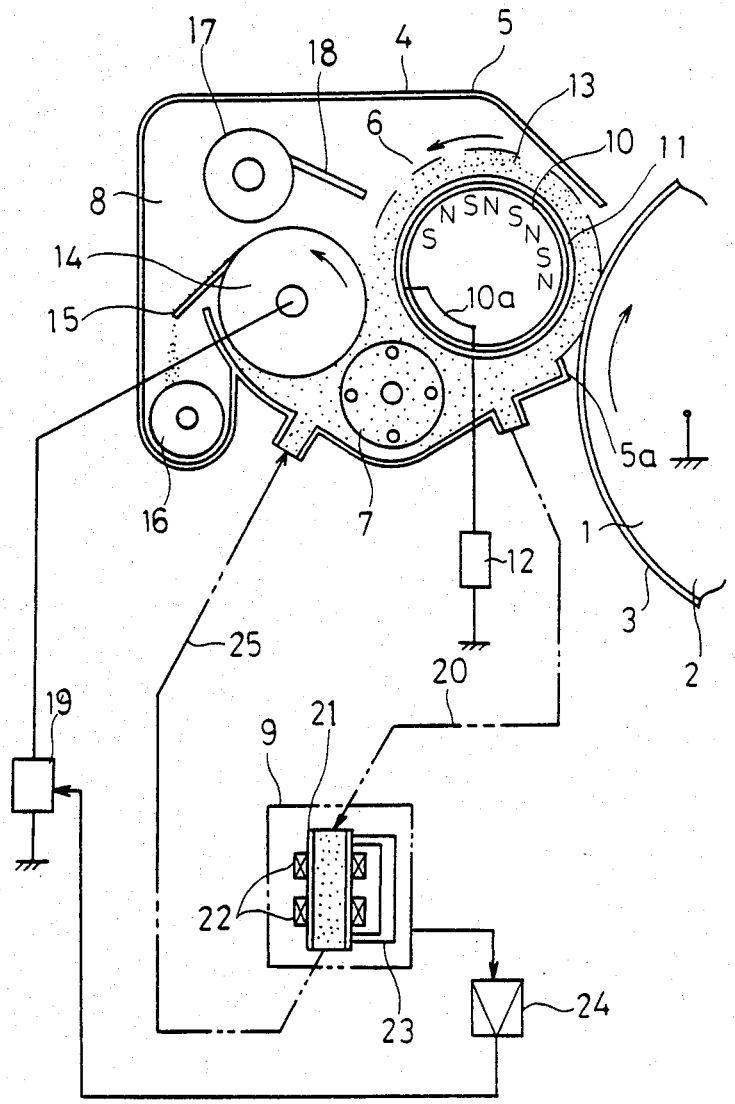
FIG. 1 is a general arrangement diagram of a cleaning device in an electrophotographic copier in an embodiment of the present invention.

FIG. 1 is a schematic arrangement diagram of a cleaning device embodying the present invention.

Referring to the figure, the electrophotographic copier has a photoconductor drum 1, which is formed with a photosensitive layer 3 on the surface of an electrically conductive drum 2 and which is rotated clockwise as indicated by an arrow, so as to perform the steps of charging, exposure, developing and transfer. The cleaning device 4 for removing toner remaining on the surface of the photosensitive layer 3 is disposed in the vicinity of the photoconductor drum 1. This cleaning device 4 is so constructed that a magnetic brush assembly 6, a stirrer 7 and a toner recovery assembly 8 are received inside the housing 5, while a detector 9 for detecting the toner density of a magnetic brush material (a mixture consisting of the toner and a magnetic carrier) contained in the housing 5 is disposed outside this housing 5.

The magnetic brush assembly 6, which is constructed of a magnetic roll 10 and the conductive sleeve 11, is arranged near the photoconductor drum 1 so as to remove the residual toner from the surface of the photosensitive layer 3. The magnetic roll 10 is formed with magnetic poles in its parts close to the photoconductor drum 1, and with an unmagnetized portion 10*a* in its lower side part located on a side remote from the photoconductor drum 1. On the other hand, the conductive sleeve 11 is formed of a cylindrical member made of a nonmagnetic material, for example, a metal pipe made of aluminum, stainless steel or the like, and it is disposed around the magnetic roll 10 in a manner to rotate counterclockwise as indicated by an arrow. A D.C. power source 12 is connected to the conductive sleeve 11, and applies thereto a voltage in the opposite polarity to the charged polarity of the toner. Further, the surface of the conductive sleeve 11 is knurled so as to prevent the magnetic brush material from slipping. Accordingly, the magnetic brush assembly 6 is so constructed that the magnetic brush material is attracted on the rotating conductive sleeve 11 by the magnetic force of the magnetic roll 10, thereby to form a magnetic brush 13, and that as the conductive sleeve 11 rotates, such magnetic brush 13 slindingly rubs the surface of the photosensitive layer 3 and removes the residual toner therefrom. In the unmagnetized portion 10*a* of the magnetic roll 10, the magnetic brush material drops from the surface of the conductive sleeve 11. The magnetic brush 13 has the lengths of the bristles made uniform by a protrusion 5*a* with which the housing 5 is formed.

The stirrer 7 is a cage roll which is arranged obliquely below the magnetic brush assembly 6, and which stirs the magnetic brush material having dropped from the surface of the conductive sleeve 11 of the magnetic brush assembly 6.

Further, the toner recovery assembly 8 is constructed of an electrically conductive roll 14 which is arranged in the vicinity of the magnetic brush assembly 6 as well as the stirrer 7, whose surface is slidingly rubbed by the magnetic brush 13 formed on the conductive sleeve 11 of the magnetic brush assembly 6 and which rotates counterclockwise as indicated by an arrow; a scraper 15 which scrapes away the toner adhering on the conductive roll 14; a screw conveyor 16 which conveys the toner scraped away by the scraper 15, to a developing device, a recovery container or the like (not shown); a magnetic roll 17 which is arranged above the conductive roll 14 and which attracts the magnetic carrier adhering on the conductive roll 14; and a blade 18 which scrapes the magnetic carrier away from the magnetic roll 17. A D.C. power source 19 is connected to the conductive roll 14, and applies thereto a voltage in the opposite polarity to the charged polarity of the toner. Accordingly, the toner recovery assembly 8 operates so that the conductive roll 14 attracts the toner in the stirred magnetic brush material and the toner in the magnetic brush 13 slidingly rubbing it, in accordance with the voltage application from the D.C. power source 19 and then transports them in the counterclockwise direction, and that such transported toner is scraped away by the scraper 15 and then recovered by the screw conveyor 16. Even in a case where the magnetic carrier has mixed with the toner and transported by the conductive roll 14, it is attracted and removed by the magnetic roll 17 before reaching the scraper 15, whereupon it is returned into the original magnetic brush material by the blade 18.

The detector 9 detects the toner density in terms of the magnetic permeability of the magnetic brush material by utilizing the phenomenon that the permeability becomes low when the quantity of the toner in the magnetic brush material increases, whereas the former becomes high when the latter decreases. It is so constructed that the magnetic brush material in the housing 5 is fed into a detecting tube 21 through a transport path 20, that the magnetic permeability of the fed magnetic brush material is detected by coils 22, 22 and a core 23, and that the resulting detecting signal is delivered to the D.C. power source 19 of the toner recovery assembly 8 through an amplifier 24, so as to vary the voltage of the D.C. power source 19 in accordance with the magnetic permeability of the magnetic brush material. More specifically, when the magnetic permeability of the magnetic brush material is low, that is, when the toner density is high, the detector 9 raises the voltage of the D.C. power source 19 so as to increase the quantity of the toner to be attracted to the conductive roll 14. In contrast, when the magnetic permeability of the magnetic brush material is high, that is, when the toner density is low, the detector 9 lowers the voltage of the D.C. power source 19 so as to decrease the quantity of the toner to be attracted to the conductive roll 14. In this case, the magnetic brush material fed into the detecting tube 21 is returned into the housing 5 through a transport path 25.

Now, the operations of the cleaning device 4 constructed as described above will be explained. First, the photoconductor drum 1 is subjected to the steps of charging, exposure, developing and transfer. Thereafter, when the toner remaining on the surface of the photosensitive layer 3 has been fed clockwise as indicated by the arrow, the magnetic brush 13 formed on the condutive sleeve 11 by the magnetic force of the magnetic roll 10 rubs the surface of the photosensitive layer 3 slidingly and removes the residual toner therefrom while rotating along with the conductive sleeve 11 and in the counterclockwise direction as indicated by the arrow. The toner thus removed advances with the rotation of the conductive sleeve 11, and it separates away from the conductive sleeve 11, along with the magnetic carrier, and then falls within the housing 5 at the position of the unmagnetized portion 10*a* of the magnetic roll 10. The toner and the magnetic carrier having fallen are stirred by the stirrer 7 so as to become uniform. Part of the magnetic brush material, which has been stirred to be uniform in this way, is fed into the detecting tube 21 of the detector 9 through the transport path 20 and has its toner density detected here. The detection signal is applied from the detector 9 to the D.C. power source 19 of the toner recovery assembly 8, so that the voltage of the D.C. power source 19 is varied in accordance with the toner density. When the voltage of the D.C. power source 19 has been varied in this manner, the quantity of the toner to be attracted to the conductive roll 14 of the toner recovery assembly 8 is controlled in accordance with the toner density. The toner attracted to the conductive roll 14 is transported counterclockwise as indicated by the arrow, with the rotation of the conductive roll 14, and is scraped off by the scraper 15. The toner scraped off is transported to the developing device or the like by the screw conveyor 16. In this case, even when the magnetic carrier has mixed in the toner and has been attracted to and transported by the conductive roll 14, it is attracted to the magnetic roll 17 and removed from the conductive roll 14 before reaching the position of the scraper 15, whereupon it is returned into the housing 5 again by the blade 18.

In this manner, the cleaning device 4 is so constructed that the toner density of the magnetic brush material in the housing 5 is detected by the detector 9 and that the toner recovery rate of the toner recovery assembly 8 is controlled on the basis of the detection signal. Therefore, the toner density of the magnetic brush material in the housing 5 can be held constant at all times. For this reason, the magnetic brush 13 formed of the magnetic brush material on the surface of the magnetic brush assembly 6 is always held in a good state, and the toner remaining on the surface of the photosensitive layer 3 can be removed favorably without any damage of this surface.

Now, another embodiment of the present invention will be described with reference to the drawings.

Figure 2:
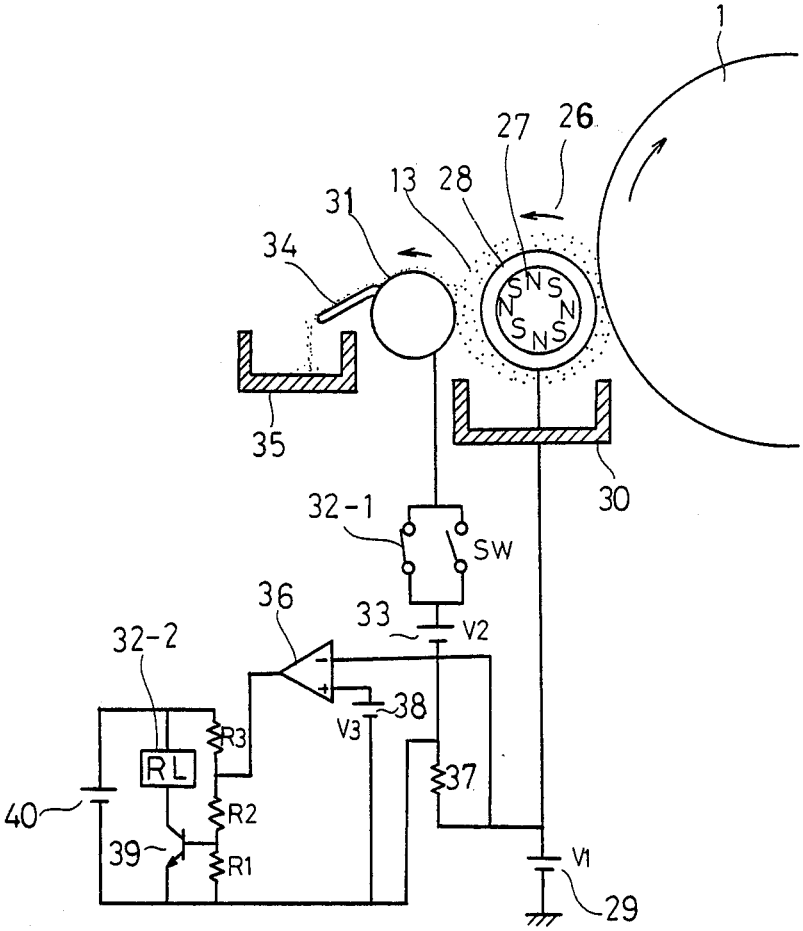
FIG. 2 is a principle diagram showing the outline of a cleaning device in another embodiment of the present invention.

FIG. 2 is a schematic principle diagram illustrative of a cleaning device embodying the present invention.

Referring to FIG. 2, numeral 1 designates a photoconductor drum, in the vicinity of which a magnetic brush assembly 26 is disposed. The magnetic brush assembly 26 has a magnetic roll 27, and a rotatable electrically-conductive sleeve 28 which is disposed around the magnetic roll. A magnetic brush 13, which is formed on the surface of the conductive sleeve 28 by the magnetic force of the magnetic roll 27, rubs the surface of the photoconductor drum 1 slidingly. A voltage $V_1$, e.g., 400 V which is higher than the potential of the photoconductor drum 1, is applied from a D.C. power source 29 to the conductive sleeve 28 through a collector brush, not shown. In the present embodiment, a portion for reserving the magnetic brush material is shown as a toner/carrier receiver 30 in model-like fashion. Numeral 31 designates an electrically-conductive roll which slidingly rubs the magnetic brush 13 formed on the conductive sleeve 28 by the magnetic force of the magnetic roll 27, on a side remote from the photoconductor drum 1 with respect to the magnetic brush assembly 26, and which serves to recover the excess toner and to maintain the toner density in the magnetic brush 13 at an appropriate value. Upon closure of a switch SW or a relay contact 32-1, this conductive roll 31 is supplied through a collector brush with a voltage, e.g., 600 V which is higher than the voltage $V_1$ of the D.C. power source 29 applied to the conductive sleeve 28. As a power source therefor, a D.C. power source 33 is disposed which has a voltage $V_2$ (200 V in the example). Shown at numeral 34 is a scraper which abuts on the conductive roll 31 and serves to scrape off the toner adhering on the surface of the conductive roll 31. In the present embodiment, the toner scraped off by the scraper 34 is illustrated as being gathered into a toner receiver 35, in model-like fashion. The minus side of the D.C. power source 29 is grounded, while the plus side thereof is connected to the conductive sleeve 28 and is also connected to the minus (inverting) input terminal of a comparator 36 and a detecting resistor 37. In addition, the plus (noninverting) input terminal of the comparator 36 is connected with the plus side of a D.C. power source 38. The minus side of the D.C. power source 38 is connected to the node between the detecting resistor 37 and the minus side of the D.C. power source 33, and to a bias resistor $R_1$ disposed between the base and emitter of a transistor 39. On the other hand, the output of the comparator 36 is coupled between voltage dividing resistors $R_2$ and $R_3$. A relay RL 32-2 for opening or closing the aforementioned relay contact 32-1 is disposed between the voltage dividing resistor $R_3$ and the collector of the transistor 39. Further, a relay driving power source 40 is disposed between the emitter of the transistor 39 and the relay RL 32-2.

The switch SW is so constructed as to operate for a predetermined period of time at the starting of each of the copying operations of a first copy, a second copy, a third copy, . . . . On the other hand, the relay contact 32-1 is opened and closed under the control of the relay RL 32-2 in accordance with the output of the comparator 36.

The residual toner on the photoconductor drum 1 adheres in the state in which it is charged in a predetermined polarity. By way of example, the toner electrically adhering on the photoconductor drum 1 to which a positive potential is applied is negatively charged. On the other hand, the conductive sleeve 28 of the magnetic brush assembly 26 has a potential applied thereto, the potential being in the positive polarity and higher than the surface potential of the photoconductor drum 1.

In general, when an electric charge e exists at an arbitrary point which has an electric field intensity $\vec{E}$, a force $\vec{F}$ acting on the point charge is given by:

$$\vec{F}=e\vec{E} \quad (1)$$

Here, in an electrostatic field, the electric field intensity $\vec{E}$ is obtained from an electrostatic potential (scalar potential) $\phi$, as follows:

$$\vec{E} = -\text{grad}\ \phi \quad (2)$$

It is understood from the above that, in the field in which Equations (1) and (2) hold, namely, in the field which conforms with Coulomb's law, generally the magnitude of the force acting on the point charge is greater as the bias voltage is higher. That is, as the bias voltage $V_1$ is higher, the quantity of the adhesion of the residual toner to the magnetic brush 13 becomes larger, and the cleaning efficiency becomes higher. It is accordingly understood that the efficiency of toner recovery to the conductive roll 31 is enhanced more as the bias voltage $(V_1+V_2)$ of the conductive roll 31 is higher than the bias voltage $V_1$ which is applied to the conductive sleeve 28.

The magnetic brush material is made of the mixture which consists of the carrier and the toner. In them, the magnetic carrier has a certain degree of electric conductivity, but the toner is an electric insulator. Therefore, when the mixing ratio of the toner becomes high, the resistance value of the magnetic brush material increases.

After an electrostatic latent image on the photoconductor drum 1 has been developed with the toner and then transferred onto a sheet of transfer paper, the toner not having been transferred rushes into the magnetic brush cleaning portion while remaining on the photoconductor drum 1. In the magnetic brush cleaning portion, the voltage $V_1$ which is higher than the voltage applied to the photoconductor drum 1 is applied to the conductive sleeve 28 by the D.C. power source 29. Moreover, the residual toner on the photoconductor drum 1 is charged in the opposite polarity to the polarity of the voltage of the conductive sleeve 28. Therefore, such residual toner adheres to the magnetic brush 13 on the conductive sleeve 28, and the cleaning of the photoconductor drum 1 is effected. The toner in the magnetic brush 13 is attracted to the conductive roll 31 by applying the voltage $(V_1+V_2)$ higher than the voltage of the conductive sleeve 28, whereupon the attracted toner is scraped off by the abutting scraper 34 and recovered into the toner receiver 35.

Regarding the above cleaning operation, in such a case where the copying machine is continuously run over a long time, a predetermined cleaning efficiency might not be attained due to increase in the toner density of the magnetic brush material. This fear is eliminated as described below. The switch SW turns CN for the predetermined period of time at the starting of each copying operation, whereby current flows through a closed circuit which consists of the D.C. power source 33—switch SW—conductive roll 31—magnetic brush 13—conductive sleeve 28—detecting resistor 37. In case of applying the fixed voltages, the value of the current increases or decreases as the resistance value of the magnetic brush material changes depending upon the mixing ratio of the toner in the magnetic brush 13. It is accordingly possible that, when the toner density of the magnetic brush 13, namely, the toner density of the magnetic brush material is a preset reference density, a voltage across the detecting resistor 37 included in such closed circuit is set as a reference voltage, through which the increase or decrease of the toner density is controlled. Now, the toner density and the reference voltage will be described more in detail with reference to FIG. 3.

Figure 3:
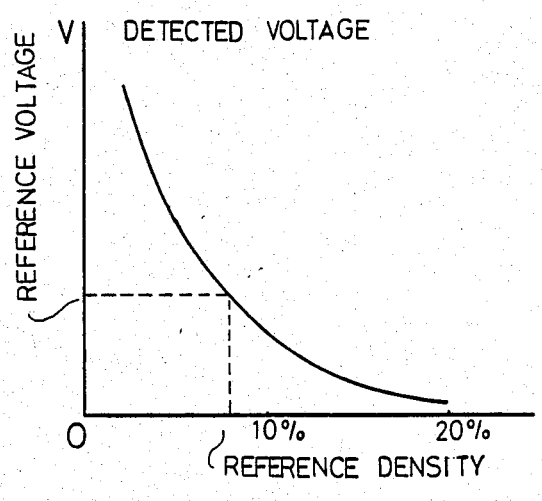
FIG. 3 is a graph showing the relationship between the density of toner in a magnetic brush material and the detected voltage developing across a detecting resistor, in the embodiment of FIG. 2.

FIG. 3 is a graph showing the relationship between the toner density and the detected voltage in the embodiment of the present invention illustrated in FIG. 2. It is seen from the graph that the toner density of the magnetic brush material and the voltage across the detecting resistor 37, i. e., the detected voltage are inversely proportional. The reason is that, when the toner density of the magnetic brush material increases, the resistance of the magnetic brush 13 increases, so the current to flow through the circuit decreases, and the voltage to develop across the detecting resistor 37 lowers accordingly. It is supposed that the current to flow through the closed circuit is, e.g., 100 $\mu$A in case of setting the reference toner density at, e.g., 8%. Then, a voltage of 10 V develops across the detecting resistor 37 of 100 k$\Omega$. Accordingly, the reference voltage is set at 10 V. The magnetic carrier usually has a resistance value at $10^5$–$10^6$ $\Omega$cm, and it exhibits $10^7$–$10^8$ $\Omega$cm when the toner is mixed therein.

In the copier, upon depressing a print button (not shown), the photoconductor drum 1, conductive sleeve 28 and conductive roll 31 start rotating before the formation of an image, so that the magnetic brush 13 starts rotating, too. At the same time, the switch SW turns ON for the predetermined period of time, the aforementioned circuit is closed, and the D.C. voltage $V_2$ is applied to the conductive roll 31. After lapse of the predetermined period of time, the switch SW turns OFF, and the circuit is opened. When the D.C. voltage $V_2$ is applied to the conductive roll 31, the current corresponding to the toner density of the magnetic brush 13 flows through the detecting resistor 37, and the voltage across such detecting resistor 37 is compared by the comparator 36 with the reference voltage $V_3$ of the D.C. power source 38 separately disposed.

In a case where the toner density of the magnetic brush 13 is higher than the reference density when the switch SW has turned ON for the predetermined period of time, the current to flow through the detecting resistor 37 becomes small, and the voltage to develop across the detecting resistor 37, namely, an input voltage to the minus input terminal of the comparator 36 becomes lower than the reference voltage $V_3$ applied to the plus input terminal of the comparator 36, so that the output of the comparator 36 becomes a high level H. Accordingly, the transistor 39 effects a switching operation, a current flows through the relay RL 32-2, and the relay contact 32-1 is turned ON. Thus, even when the switch SW becomes open, the voltage $V_2$ continues to be applied because a circuit consisting of the relay contact 32-1—conductive roll 31—magnetic brush 13—conductive sleeve 28—detecting resistor 37 is kept closed. Since the voltage $(V_1+V_2)$ is applied to the conductive roll 31, the surplus toner in excess of, e.g., the reference density of 8% is recovered to the conductive roll 31, so that the toner density of the magnetic brush 13 decreases gradually. When this toner density has reached the reference density, the current flowing through the detecting resistor 37 increases, and the detected voltage increases to become higher than the corresponding reference voltage $V_3$, so that the output of the comparator 36 becomes a low level L. Accordingly, the transistor 39 turns OFF, the relay RL 32-2 turns OFF, and the relay contact 32-1 is opened.

Next, in a case where the toner density of the magnetic brush 13 is lower than the reference density when the switch SW has turned ON for the predetermined period of time, a great current flows through the closed circuit referred to above, and the detected voltage of the detecting resistor 37 becomes higher than the reference voltage $V_3$, so that the output of the comparator 36 becomes the low level L. Accordingly, the transistor 39 is not switched, and the relay RL 32-2 remains OFF to leave the open relay contact 32-1 intact, so that the closed circuit is established only when the switch SW is ON and is opened when the switch SW has turned OFF. Therefore, after the switch SW has turned OFF, the conductive roll 31 is not supplied with the voltage $(V_1+V_2)$, and the recovery of the toner from the magnetic brush 13 to the conductive roll 31 stops. The toner is recovered from the photoconductor drum 1 to the magnetic brush 13 each time the switch SW is turned ON, so that the toner density of the magnetic brush 13 increases again. As described above, this embodiment of the present invention detects whether or not the toner density of the magnetic brush 13 is the reference density, each time the switch SW turns ON.

In case of repeated copying, before the starting of the image forming operation corresponding to each copying, the voltage $V_2$ is applied to the conductive roll 31 for a predetermined period of time, so as to decide whether or not the detected voltage developing across the detecting resistor 37 is the reference as indicated in FIG. 3 (that is, whether or not the toner density of the magnetic brush 13 is proper). When such detected voltage is below the reference, the toner density is decided to be too high, the voltage $V_2$ from the D.C. power source 33 is kept applied to the conductive roll 31, and the toner in the magnetic brush 13 is further attracted and recovered by the conductive roll 31. In contrast, when the detected voltage across the detecting resistor 37 is above the reference, the toner density is decided to be too low, the output of the comparator 36 becomes the low level L, and the transistor 39 and the relay RL 32-2 fall into the OFF states, so that the relay contact 32-1 is open, and the voltage $(V_1+V_2)$ based on the D.C. power sources 29 and 33 is not applied to the conductive roll 31. Accordingly, the recovery of the toner by the conductive roll 31 is not performed. Therefore, in accordance with a repetition of a copying operation, the toner density increases gradually to approach the proper value. Thus, derected voltage lowers gradually to approach the reference voltage.

By controlling the toner density with the method as stated above, the density of the toner contained in the magnetic brush 13 is permitted to be controlled into a substantially constant value. The present embodiment is so constructed as to control the toner density in such a way that the change of the current flowing between the conductive sleeve 28 and the conductive roll 31, which are connected through the magnetic brush 13, is detected by utilizing the D.C. bias voltage which is applied to the conductive roll 31 proximate to the conductive sleeve 28. However, a member to oppose to the magnetic brush 13 is not restricted to the toner recovering conductive roll 31, but it may of course be a toner density-detecting electrode member, for example, a mere metal plate or metal roll. It is also allowed to control the toner density of the magnetic brush material by detecting the density in any part other than the magnetic brush portion.

As thus far described, according to the present invention, the toner density of a magnetic brush material can be held constant at all times, and hence, a magnetic brush formed of the magnetic brush material on the surface of a magnetic brush assembly is always held in a good state, resulting in the effect that the residual toner can be removed favorably without any damage of the surface of a photoconductor. In addition, according to the present invention, the cleaning efficiency is high enough to form a clear copy image at all times, which brings forth the effect that the toner can be prevented from fusing and adhering to the photoconductor surface, so the durability of the photoconductor is enhanced. Further, according to the present invention, there are achieved the effects that the quantity of the toner in the magnetic brush is controllable, that the degradation of a carrier is relived, so the lifetime of the carrier lengthens, and that the cleaning effect is stabilized.

What we claim is:

1. A cleaning device for an image forming apparatus, comprising:

magnetic brush means for causing a magnetic brush material, consisting of a magnetic carrier and toner, to slidingly rub a surface of a photoconductor and removing the residual toner adhering on the photoconductor surface, toner recovery means with a bias voltage applied thereto and for electrostatically attracting and recovering the surplus toner in the magnetic brush material on the basis of the applied voltage, toner density detection means for detecting a toner density of the magnetic brush material, and bias voltage control means for controlling a voltage value of the bias voltage to be applied to said toner recovery means, in accordance with a detected output of said toner density detection means.

2. A cleaning device as defined in claim 1, wherein said magnetic brush means includes a cylindrical electrically-conductive sleeve which rotates in a predetermined direction, and a stationary magnet which is arranged inside said conductive sleeve and which attracts the magnetic brush material onto a surface of said conductive sleeve, thereby to form a magnetic brush.

3. A cleaning device as defined in claim 1, wherein said toner recovery means includes an electrically conductive roll to which the bias voltage is applied, and scraper which scrapes off the toner attracted on a surface of this conductive roll.

4. A cleaning device as defined in claim 3, wherein said toner recovery means further includes a magnetic member which is disposed in the vicinity of said conductive roll and which attracts the magnetic carrier adhering to this conductive roll.

5. A cleaning device as defined in claim 1, wherein said toner density detection means is constructed of means for detecting a magnetic permeability of the magnetic brush material.

6. A cleaning device as defined in claim 1, wherein said toner density detection means is constructed of means for detecting a resistance value of the magnetic brush material.

7. A cleaning device as defined in claim 6, wherein said means for detecting the resistance value is means for detecting a resistance value of a magnetic brush portion.

8. A cleaning device as defined in claim 6, wherein said means for detecting the resistance value is means for detecting a resistance value between said conductive sleeve and said toner recovery means.

9. A cleaning device as defined in claim 1, wherein said toner density detection means detects the toner density in interlocking with a copying operation.

10. A cleaning device as defined in claim 2, wherein said conductive sleeve has a bias voltage applied thereto and is held at a potential higher than a potential of said photoconductor surface.

11. A cleaning device as defined in claim 10, wherein said bias voltage is lower in potential than the bias voltage which is applied to said toner recovery means.

* * * * *

UNITED STATES PATENT AND TRADEMARK OFFICE

CERTIFICATE OF CORRECTION

PATENT NO. : 4,470,694

DATED : September 11, 1984

INVENTOR(S) : Sokichi MURAKAMI et al.

It is certified that error appears in the above-identified patent and that said Letters Patent is hereby corrected as shown below:

In the cover page, column 1, after item 22, item 30 should be inserted to read as follows:

--[30] Foreign Application Priority Data
Dec. 18, 1981 [JP] Japan.....56-203647
Oct. 7, 1982 [JP] Japan.....57-176768--

Signed and Sealed this

*Fifth* Day of *March 1985*

[SEAL]

*Attest:*

DONALD J. QUIGG

*Attesting Officer* *Acting Commissioner of Patents and Trademarks*